US006068772A

United States Patent [19]

Czerwoniak et al.

[11] Patent Number: 6,068,772

[45] Date of Patent: May 30, 2000

[54] APPARATUS FOR PROCESSING FIBER SUSPENSIONS INTENDED FOR THE PRODUCTION OF PAPER OR CARDBOARD

[75] Inventors: Erich Czerwoniak, Pfullingen; Emil Holz, Eningen; Hagen Wilhelm Hutzler, Reutlingen; Jochen Gustav Pfeffer, Eningen, all of Germany

[73] Assignee: Hermann Finckh Maschinenfabrik GmbH & Co., Pfullingen, Germany

[21] Appl. No.: 09/099,986

[22] Filed: Jun. 19, 1998

Related U.S. Application Data

[63] Continuation of application No. PCT/EP96/00888, Mar. 2, 1996.

[30] Foreign Application Priority Data

Dec. 21, 1995 [DE] Germany ..... 195 47 946

[51] Int. Cl.[7] ..... B01D 21/26; B04C 3/00; B04C 3/06

[52] U.S. Cl. ..... 210/512.3; 210/359; 210/512.1; 209/725

[58] Field of Search ..... 210/359, 512.1, 210/512.3; 209/208, 210, 725

[56] References Cited

U.S. PATENT DOCUMENTS

| | | | |
|---|---|---|---|
| 3,964,996 | 6/1976 | Holz et al. | 209/273 |
| 5,131,544 | 7/1992 | Serres et al. | 209/210 |
| 5,149,345 | 9/1992 | Bouchard et al. | 55/406 |

FOREIGN PATENT DOCUMENTS

| | | |
|---|---|---|
| 0 359 682 | 3/1990 | European Pat. Off. . |
| 0 422 555 | 4/1991 | European Pat. Off. . |
| 2 264 595 | 10/1975 | France . |
| 2943298A | 10/1979 | Germany . |
| 29 43 298 | 4/1981 | Germany . |

*Primary Examiner*—John Kim
*Attorney, Agent, or Firm*—Leydig, Voit & Mayer, Ltd.

[57] ABSTRACT

An apparatus for processing fiber suspensions containing usable fibers and suspended dirt particles to be separated from the usable fibers, the specific weight of the particles differing distinctly from that of the usable fibers, is described. The apparatus comprises a drum-shaped outer housing having (i) and inflow end accommodating a body rotationally symmetric to the housing axis and being provided with a tangential inlet pipe for the fiber suspension to be processed, and (ii) an outflow end being provided with an axial outlet pipe for a lightweight dirt component of the suspension and an outlet pipe for a usable component of the suspension. In order to also separate a heavy dirt component of the suspension, and to minimize cost due to wear, the housing and the outlet pipe for the usable component are stationary, the rotationally symmetrical body is a rotor rotationally drivable about the housing axis, and a separating wall rotationally symmetrical with the housing axis is provided for defining an outer annular chamber between the circumferential housing wall and the separating wall. The annular chamber is open at its one end facing the rotor and is provided at its other end with a radial outlet pipe for heavy dirt particles. The separating wall further circumscribes an inner annular chamber circumscribing the outlet pipe for the lightweight dirt component, and the outlet pipe for the usable component opens into the inner annular chamber.

24 Claims, 4 Drawing Sheets

APPARATUS FOR PROCESSING FIBER SUSPENSIONS INTENDED FOR THE PRODUCTION OF PAPER OR CARDBOARD

The present invention is a continuation of PCT/EP96/00888 (International Publication No. WO 97/23688), filed Mar. 2, 1996, which application elected the United States of America. The entire contents of this prior application are incorporated by reference.

The invention relates to an apparatus for processing fiber suspensions intended for the production of paper or cardboard and, in particular, fiber suspensions obtained from waste paper, the fiber suspensions containing particles to be separated from the usable fibers of the suspension, the specific weight of the particles differing distinctly from that of the usable fibers.

In the course of processing the fibrous material intended for the production of paper or cardboard, the fiber suspension obtained by dissolving the fibrous material is first freed from coarse impurities such as, for example, wires, strings, pieces of plastic film and the like, by means of a sorting apparatus whose screen openings have a diameter of, for example, 7 mm. This coarse sorting is carried out in a so-called thick stock range, i.e., at a stock density of approximately 4% (solids component of the fiber suspension). This coarse sorting is followed by a presorting to free the fiber suspension from coarse heavy dirt (impurities of heavy specific weight), for example, from stones, quite large splinters of glass and metal clips, but also from coarse lightweight dirt (impurities of light specific weight) such as pieces of plastic of light specific weight and relatively large agglomerates of fibers (flakes). This presorting is usually also carried out in the so-called thick stock range, and sorting apparatuses are used whose screen openings have a diameter of, for example, 1.2 to 2.5 mm.

To date, after the coarse sorting and the presorting have been carried out at two stages, a fine sorting is usually carried out with sorting apparatuses whose screen openings are slot-shaped and have a slot width of down to 0.1 mm. Formerly, this was carried out in the so-called thin stock range (stock density less than 2%) in order to be able to work in a disturbance-free way with slot widths of 0.35 to 0.2 mm. However, more recent developments enable performance of the fine sorting in the thick stock range at approximately 4% stock density and with extremely fine slots. Working in the thick stock range involves a considerable potential for saving energy (smaller amounts of suspension have to be processed in relation to the quantity of fibers), however, fine sorting in the thick stock range proves inadequate for the production of many kinds of paper; in particular, fine impurities of heavy specific weight such as sand, fine splinters of glass and the like cannot be screened out while working in the thick stock range, but rather suitable apparatuses available on the market require stock densities of under 2% to be worked with in order to separate off such impurities.

Currently, so-called cleaners are used to screen off sand and other fine heavy dirt, more specifically, in cleaner plants comprising several consecutive stages, each of which has such a cleaner.

The known so-called centricleaners operate fluidically in accordance with the principle of the free vortex. In a conical vessel tapering downwards, the fiber suspension to be freed of fine heavy dirt is set in rotation by being introduced at the top tangentially into the cleaner housing under high pressure and hence at high velocity so as to generate a free vortex in which the fiber suspension flows in helical line configuration downwards. Herein tangential and angular velocities increase progressively as the housing diameter decreases progressively, and likewise the centrifugal forces acting on the dirt particles of heavy specific weight. The heavy dirt thus conveyed against the circumferential wall of the cleaner and downwards therein is separated off through a central opening at the lower end of the cleaner housing, whereas the portion of the suspension (accepted stock) containing the usable fibers in the vortex core rises and exits at the top of the cleaner housing through an outlet pipe for accepted stock which protrudes from above into the cleaner housing in the housing axis and thus separates the accepted stock rising in the vortex core from the fiber suspension to be treated as it enters the cleaner. Owing to the way in which they operate as described above, cleaner installations require a high amount of energy (high pumping capacities for generating the necessary high pressure differences). Also, cleaners must not be built too large otherwise they do not screen off effectively, i.e., such a cleaner can only process a relatively small amount of suspension per time unit. Furthermore, the high rotational speeds result in considerable wear at the circumferential wall of the cleaner housing, and the amount of so-called rejected stock (suspension component separated off with the screened-out heavy dirt) amounts to approximately 5%.

As only heavy dirt can be separated off with a normal centricleaner, the screening off of impurities of light specific weight (lightweight dirt) requires cleaner apparatuses which can be so-called degasifying cleaners or pure lightweight dirt cleaners. These cleaners also operate fluidically according to the principle of the free vortex. They have a vertical, conical, downwardly tapering cleaner housing. The fiber suspension to be treated flows at the top tangentially and under high pressure and at high speed into the cleaner. Lightweight dirt (and possibly air) rising in the vortex core, i.e., in the housing axis is discharged through a central axial outlet pipe for lightweight dirt, and the accepted stock is taken away through an outlet pipe of quite large diameter for accepted stock which surrounds the outlet pipe for lightweight dirt and likewise projects from above into the cleaner housing.

These cleaners used for separating off lightweight dirt also have a considerable energy requirement (pump capacity), can only process relatively small amounts of suspension and produce large amounts of rejected stock (suspension component exiting together with the lightweight dirt) of up to 20%. However, large amounts of rejected stock increase either the amount of still usable fibers lost or the energy requirement (owing to the necessity for further treatment of the rejected stock in order to recover the usable fibers).

The object underlying the invention was to provide an apparatus which is as efficient as possible with respect to wear problems and energy requirement for processing fiber suspensions, in particular, obtained from waste paper, with which particles whose specific weight differs distinctly from that of the usable fibers can be effectively separated off from the fiber suspension.

Apparatuses operating fluidically according to the principle of a forced vortex are already known for the last-mentioned purpose. Such an apparatus is offered by the company E. & M. Lamort, F-51302 Vitry-Le-Francois, under the designation GYROCLEAN GYS. This apparatus has a drum-type outer housing in the form of a hollow circular cylinder with end walls and a horizontally extending housing axis which is set in rotation about its axis by a rotary drive. Via an inlet pipe coaxial with the housing axis at one end of the housing, the fiber suspension to be treated is introduced in axial direction into the outer housing. In the zone of its inflow end, the outer housing accommodates a stationary body which is rotationally symmetrical in relation to the housing axis and by means of which the inflowing fiber suspension is diverted to the circumferential wall of the outer housing. As the latter rotates, a vortex is forced in the annular chamber between the stationary rotationally symmetrical body and the circumferential wall of the outer housing in the inflowing fiber suspension so the lightweight dirt collects in the vortex core downstream of the stationary rotationally symmetrical body. At the other end of the rotating outer housing, there projects into it an outlet pipe for rejected stock which is coaxial with the housing axis and through which the rejected stock containing lightweight dirt leaves the apparatus. At this outflow end, the rotating outer housing is further provided with an outlet pipe connection for accepted stock which is coaxial with the housing axis, surrounds the outlet pipe for rejected stock and has a distinctly larger diameter than the latter. The suspension component containing essentially only usable fibers is meant to leave the apparatus through this outlet pipe connection.

This known apparatus has the advantage that the fiber suspension to be treated has to be fed to the apparatus at a considerably lower pressure than with an apparatus which operates according to the principle of the free vortex, but it also has a number of disadvantages: There is no provision for separating off heavy dirt, several slide-type seals are required which have a considerable diameter, namely at the inlet pipe for the fiber suspension to be treated and at the outlet pipe connection for the accepted stock, and, consequently, owing to the high relative speeds between stationary sealing ring and rotating sealing ring are subjected to a high degree of wear, and the abrasively acting heavy dirt particles cause considerable wear not only at the stationary, rotationally symmetrical body provided at the inflow end but also at the inflow end of the outer housing whose rotation forces the vortex, as the fiber suspension must be accelerated in the direction of rotation there, and, consequently, a considerable rotatory relative speed is unavoidable between fiber suspension to be accelerated and outer housing. There is to be added to the energy requirement of this apparatus that of a centricleaner with which heavy dirt is separated off from the fiber suspension.

A similar apparatus of the LAMORT company, which is known from EP-0 359 682-B1, does not have the last-mentioned deficiency as both lightweight dirt and heavy dirt can be separated off with it, but all of the other disadvantages also have to be tolerated with this other apparatus as it differs from the GYROCLEAN GYS apparatus only in that the stationary, rotationally symmetrical body of the last-mentioned apparatus is replaced by a body likewise rotating about the axis of the outer housing which has approximately the configuration of two axially successive truncated cones with a middle constriction, in the area of which a suspension component which is supposed to contain lightweight dirt is withdrawn via a radially oriented channel opening into an outlet pipe for lightweight dirt which is coaxial with the axis of the outer housing. The outlet pipe connection for accepted stock provided at the outflow end of the apparatus is surrounded by an outlet pipe connection for heavy dirt likewise rotating together with the outer housing so that even three slide-type seals which are highly susceptible to wear are required at the outflow end of the apparatus according to EP-0 359 682-B1, namely at the outlet pipe connection for heavy dirt, at the outlet pipe connection for accepted stock, and between the latter and the outlet pipe for lightweight dirt.

In accomplishing the set object the starting point is an apparatus comprising an essentially drum-shaped outer housing accommodating in the zone of its one inflow end a body which is essentially rotationally symmetrical in relation to the housing axis, the outer housing being provided with an inlet for the fiber suspension to be processed and accommodating in the zone of its other outflow end a stationary outlet pipe (outlet for lightweight dirt) concentric with the housing axis for a first portion of the suspension (lightweight dirt component) containing particles of light specific weight to be separated off, and the outer housing being provided with an accepted stock outlet for a second portion of the suspension (accepted stock) containing essentially usable fibers, and further comprising a rotary drive for generating in the annular chamber between the outer housing and the rotationally symmetrical body a flow component which is rotatory in relation to the housing axis. In accordance with the invention it is proposed that such an apparatus be designed such that the outer housing and the accepted stock outlet are stationary, and the rotationally symmetrical body is in the form of a rotor rotationally drivable about the housing axis, that a separating wall rotationally symmetrical with the housing axis is provided, the separating wall forming together with the circumferential wall of the outer housing an outer annular chamber which is open at its end facing the rotor and is closed in the opposite direction, the outer annular chamber being provided at an axial distance from its open end with an outlet (outlet for heavy dirt) for a third portion of the suspension (heavy dirt component) containing particles of heavy specific weight to be separated off, and that the accepted stock outlet communicates with the outflow end of an inner annular chamber located between the separating wall and the outlet pipe for lightweight dirt.

Not only does an apparatus according to the invention enable separation of lightweight dirt and heavy dirt, thus making a further apparatus such as a centricleaner for separating off heavy dirt superfluous, which contributes towards minimizing the energy requirement, but also only a single component with a relatively small diameter, namely a rotor drive shaft, has to be sealed off, and so seals subject to a high degree of wear can be avoided. Finally, an apparatus according to the invention can be readily designed such that components subject to wear owing to abrasive action of heavy dirt particles can be simply and economically exchanged, namely the casing of a housing forming the outer circumferential wall of the outer housing, a rotor component forming the rotor circumference, and the separating wall serving to separate accepted stock and heavy dirt component. Also the apparatus according to the invention is much easier to adapt to the fiber suspension to be processed with respect to efficient separation of lightweight dirt and heavy dirt than the apparatus according to EP-0 359 682-B1 because the diameter and the axial length of both the outlet pipe for lightweight dirt and the separating wall are readily variable, quite apart from the fact that the efficiency of the lightweight dirt separation in the apparatus known from EP-0 359 682-B1 is doubtful, as the portion of the suspension containing the lightweight dirt must be diverted twice through 90° therein in order for it to enter the radially oriented rotor bore and the axially oriented outlet pipe for lightweight dirt.

In the known apparatuses described above, which operate with a forced vortex, the fiber suspension to be processed necessarily enters the apparatus centrally and in the axial direction. This is, in principle, also possible with the apparatus according to the invention (the fiber suspension could, for example, be introduced into the apparatus via a hollow drive shaft of the rotor), however, embodiments are preferred in which the inlet for the fiber suspension to be processed is in the form of a pipe opening tangentially into the outer housing in the direction of rotation of the rotor, as the inflow speed of the fiber suspension then already leads to a circumferential speed around the housing axis, whereas with the known apparatuses in question, their rotary drive has to generate the full accelerating power.

In the known apparatuses in question the outlet for accepted stock is also axially oriented and arranged coaxially with the housing axis, and, therefore, the accepted stock has by necessity to be diverted in the direction towards the housing axis before it leaves the apparatus. This flow principle is also possible with an apparatus according to the invention, however, it is more advantageous for the accepted stock outlet to comprise a pipe leading way tangentially in the direction of rotation of the rotor, as the accepted stock which still has a certain circumferential speed at the outflow end of the apparatus can then flow unimpeded into the outlet for the accepted stock. The same applies to the portion of the suspension containing the heavy dirt, and, therefore, preferred embodiments of the apparatus according to the invention are characterized in that the outlet for heavy dirt leads away tangentially from the outer annular chamber in the direction of rotation of the rotor.

Optimum separation results are achieved with the apparatus according to the invention when the axis of its outer housing extends at least approximately horizontally—any deviation from the horizontal orientation results in an impairment of the separation results either with respect to the lightweight dirt or with respect to the heavy dirt.

As the heavy dirt tends to fall to the bottom under the influence of gravity, with an apparatus according to the invention having a housing axis extending at least approximately horizontally, the outlet for the heavy dirt is expediently arranged so as to open from below into the outer annular chamber.

Optimum separation of the suspension component carrying along at least predominantly the heavy dirt from the accepted stock is achieved by the end of the separating wall facing the rotor being located in an area of the suspension flow where the vortex generated by the rotor has not yet been appreciably braked by the circumferential wall of the outer housing, but has already been effective for such a length of time that the heavy dirt particles have been sufficiently urged in the radial direction towards the circumferential wall of the outer housing—in the axial direction of flow the vortex is braked increasingly by the stationary circumferential wall of the outer housing after the rotor. It is, therefore, recommended that the apparatus according to the invention be designed such that the separating wall exhibit at its end facing the rotor such a radial distance from the circumferential wall of the outer housing and such an axial distance from the rotor that an annular flow area generated by the rotor adjacent to the circumferential wall of the outer housing and containing on account of centrifugal forces at least a considerable portion of the heavy dirt and having a rotatory flow component in relation to the housing axis enters the outer annular chamber owing to the axial flow through the apparatus.

The same applies to the withdrawal of the suspension component containing at least a major part of the lightweight dirt—the vortex forced by the rotor causes the lightweight dirt to be urged in the direction towards the housing axis. Consequently, it is recommended that the apparatus according to the invention be constructed such that the inlet diameter of the outlet pipe for lightweight dirt at its end facing the rotor and the axial distance of the said end from the rotor be of such dimensions that a core area of the flow generated by the rotor and containing at least a considerable portion of the lightweight dirt, being concentric with the housing axis and containing the housing axis enters the outlet pipe for lightweight dirt owing to the axial flow through the apparatus.

Once the vortex forced by the rotor becomes weaker in the axial direction of the apparatus, there is the increasing danger that lightweight dirt concentrated in the area of the apparatus axis will get into the flow of accepted stock again. As both the outer housing and the outlet pipe for lightweight dirt are stationary in the apparatus according to the invention, the apparatus is readily adaptable to the fiber suspension to be processed with respect to separation of the lightweight dirt when the outlet pipe forming the outlet for the lightweight dirt is mounted for displacement in the axial direction in the outer housing of the apparatus.

In order that the rotor will accelerate the fiber suspension flowing into the apparatus as effectively as possible in the direction of rotation, it is expedient to provide the rotor at its outer circumference with elevations for accelerating the suspension in the direction of rotation. It is best for these to be exchangeable vanes in order that worn accelerator elements can be readily exchanged. If these vanes are not arranged parallel to the housing axis but somewhat at an incline to the latter, the axial flow velocity can also be influenced by this inclination, which may prove advantageous.

As will be apparent from the above explanations, the ratio of the rotor diameter to the diameter of the rotor end of the separating wall influences the efficiency of the heavy dirt separation, and it has been found that the separation of the heavy dirt is particularly effective when the outer diameter of the rotor is approximately as large as or somewhat larger than the outer diameter of the rotor end of the separating wall.

In order that the flow will not stop at the outflow end of the rotor and the lightweight dirt will be effectively urged in the direction towards the housing axis, it is advantageous for the rotor to be of conical configuration at its outflow end.

High axial flow velocities of the part of the fiber suspension carrying along at least major portions of the lightweight dirt involve the risk that considerable quantities of still usable fibers will also be carried along by this suspension component. It is, therefore, recommended that provision be made for a throttle effect in the outlet for lightweight dirt, this being most easily achieved by providing the outlet for lightweight dirt with a valve which can, of course, be arranged in a pipeline downstream from the actual apparatus. If this valve is of such design that its flow cross section is adjustable, the apparatus can also be adapted in this respect to the fiber suspension to be processed.

The same applies to the separation of heavy dirt, and, where appropriate, the withdrawal of the heavy dirt from the apparatus can even be carried out at intervals. It is, therefore, recommended that the outlet for heavy dirt be provided with a valve. Above all, when the outer annular chamber is sufficiently long and has a considerable volume, it may prove fully adequate to open this valve only from time to time.

For the purpose of adapting the apparatus according to the invention to the fiber suspension to be processed (to its stock density, the quantities and quantitative ratios of heavy dirt and lightweight dirt, and the size of the dirt particles) it is further recommended that the apparatus be driven by a three-phase AC motor which is operated via an adjustable frequency converter so that the rotor speed can be easily changed by choice of the frequency.

Where appropriate, it may prove expedient for the apparatus according to the invention to operate not only according to the principle of a forced vortex, but also additionally according to the principle of a free vortex so that with respect to separation of heavy dirt the apparatus also operates similarly to a centricleaner described at the outset. For this purpose an apparatus according to the invention can be constructed such that the separating wall is designed so as to open conically towards the rotor at least in an axial section facing the rotor, and that the separating wall has approximately at the end of the conical section remote from the rotor at least one opening for passage of heavy dirt into the outer annular chamber. The accepted stock entering the inner annular chamber is then also centrifuged once again because the conical section of the separating wall acts like a centricleaner in which a free vortex forms, and heavy dirt particles urged in the radial direction against the separating wall can pass over into the outer annular chamber through the opening, in particular, in the form of an annular gap, an effect which is reinforced by the separating wall expanding conically again between through-opening and outflow end.

Further features, advantages and details of the invention are apparent from the appended claims and/or the following description and the attached drawings of two particularly advantageous embodiments of the apparatus according to the invention. The drawings show:

Figure 1:
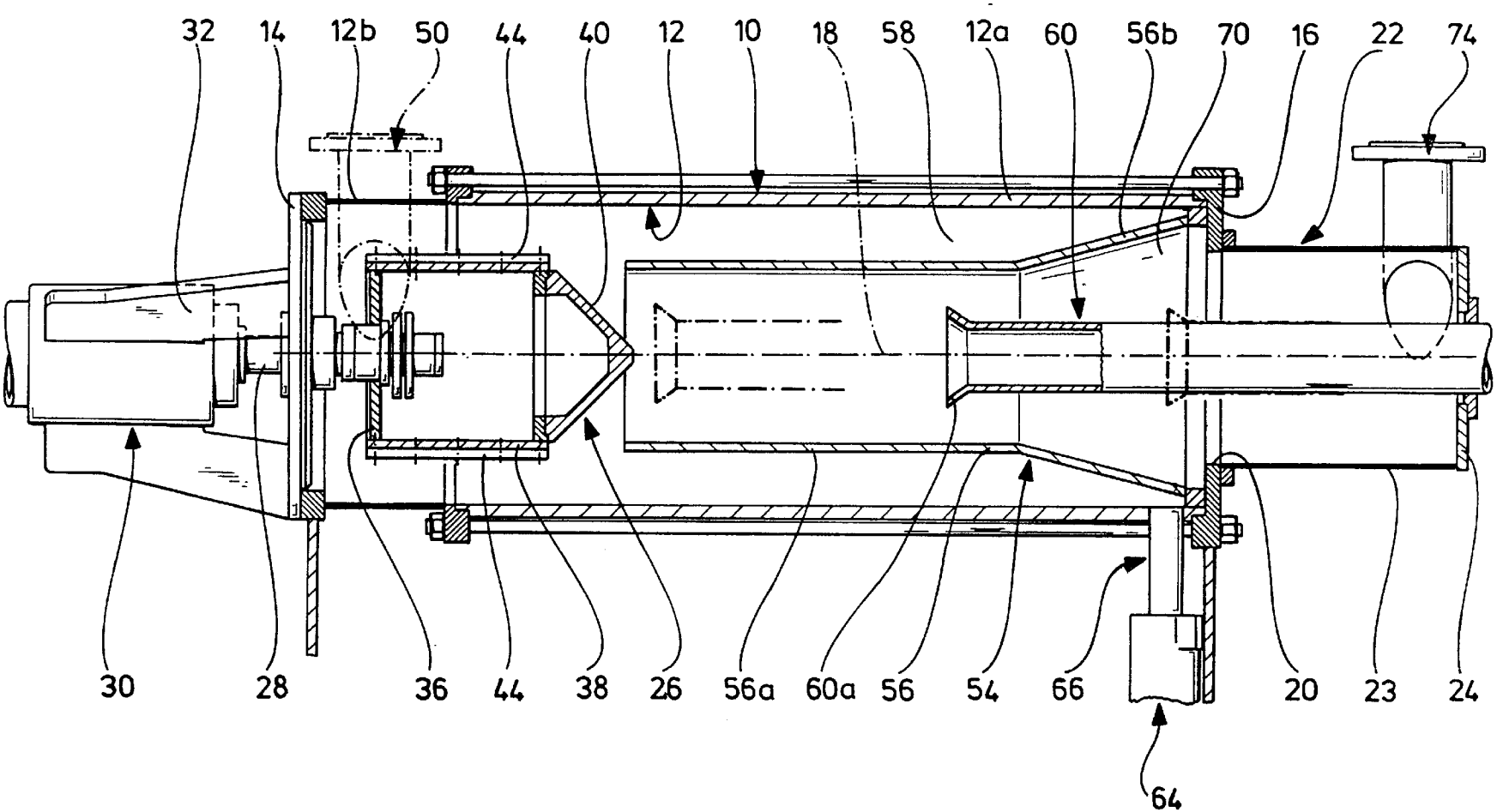
FIG. 1 a longitudinal section through the first embodiment of the apparatus.
Figure 2:
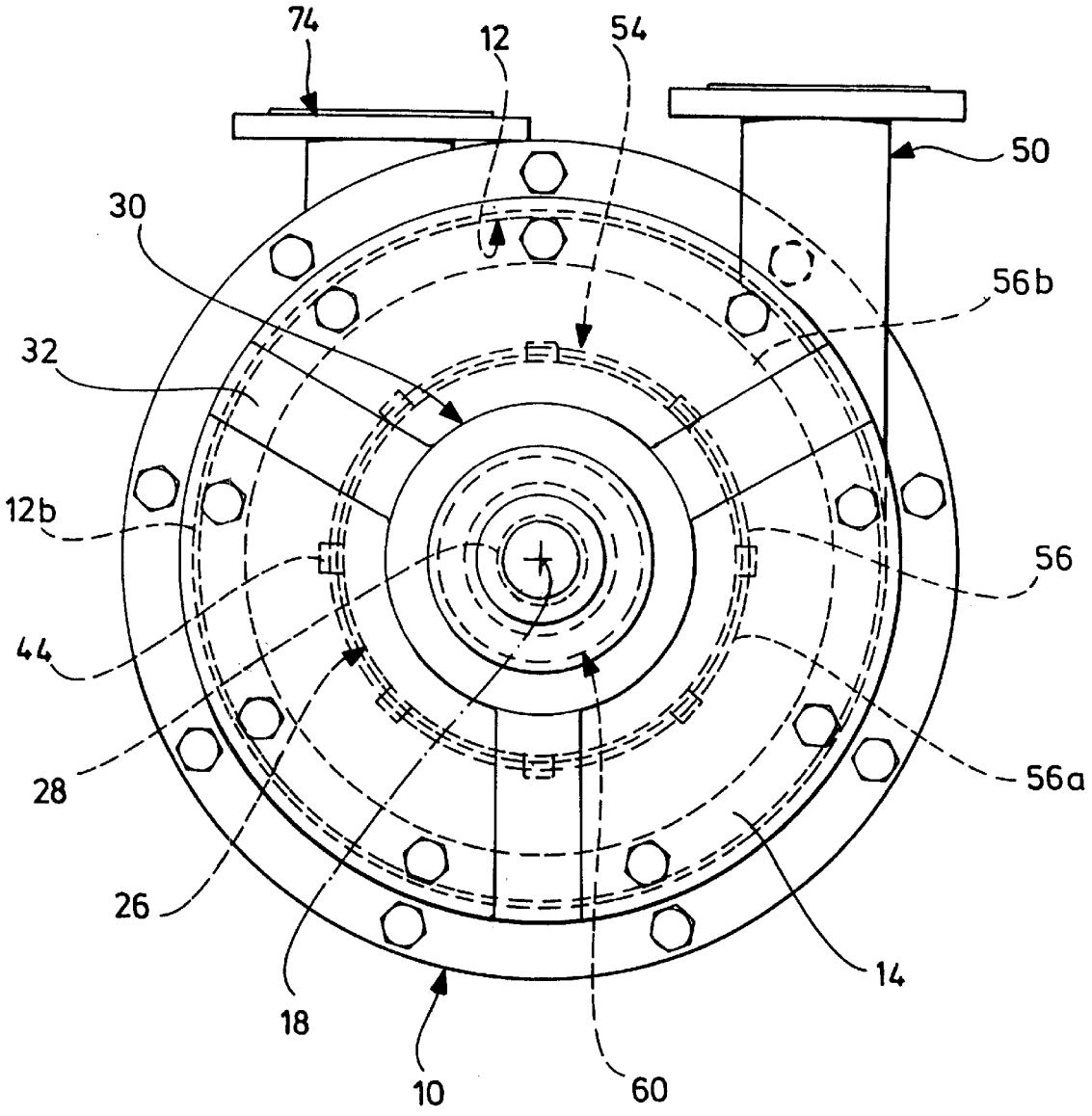
FIG. 2 an end view of the first embodiment, viewed from the left in accordance with FIG. 1.

The apparatus illustrated in FIGS. 1 and 2 comprises a housing 10 of circular-cylindrical design in accordance with the invention with a circumferential wall, designated in its entirety 12, which for manufacturing and assembly reasons only is divided into two sections 12*a* and 12*b*. The housing 10 further comprises a first end wall 14 and a second end wall 16. The end wall 16 is provided with a through-opening 20 of relatively large diameter which is concentric with an apparatus axis 18 and is adjoined by a further pot-shaped, circular-cylindrical housing coaxial with the apparatus axis 18, referred to in the following as outlet pot 22. The outlet pot 22 is secured to the end wall 16 and is provided on the right in accordance with FIG. 1 with an end wall 24.

A rotor 26 rotatingly drivable about the apparatus axis 18 and arranged coaxially with the apparatus axis is held by a drive shaft 28 which is guided in a sealed-off manner coaxially with the apparatus axis 18 through the end wall 14 and is driven by a three-phase AC motor 30 for which a support 32 is attached to the end wall 14. The rotor 26 has a rear end wall 36 which is secured to the drive shaft 28 and to which a circular-cylindrical casing 38 is attached. The casing 38 carries a conical cap 40 which together with the rotor casing 38 and the end wall 36 encloses a sealed-off cavity. Distributed over the circumference of the rotor casing 38 and exchangeably attached thereto are several accelerator vanes 44 which extend either parallel to the apparatus axis 18 or at such a slight incline thereto that they not only accelerate the fiber suspension to be processed in the direction of rotation of the rotor but also impose on the fiber suspension an axial flow component which in accordance with FIG. 1 is directed from the left to the right.

An inlet pipe connection 50 opening tangentially in the direction of rotation of the rotor 26 into the circumferential wall 12 of the housing 10 serves to introduce the fiber suspension to be treated into the housing 10 and hence into the apparatus. In accordance with the invention, the inlet pipe connection 50 is located at such a place on the circumferential wall 12 of the housing that the fiber suspension flowing into the apparatus is immediately accelerated by the rotor 26 in the direction of rotation. The inlet pipe connection 50 is preferably located at the level of the left end area of the rotor casing 38 in accordance with FIG. 1.

The end wall 16 carries a pipe 54 for separating heavy dirt which is concentric with the apparatus axis 18 and is formed by a separating wall 56 which is rotationally symmetrical in relation to the apparatus axis 18. The separating wall 56 has a circular-cylindrical section 56*a* at the inflow end and a frustoconical wall section 56*b* at the outflow end and forms together with the circumferential wall 12 of the housing an outer annular chamber 58 which tapers from the left to the right in accordance with FIG. 1 in the area of the separating wall section 56*b*.

An outlet pipe 60 for lightweight dirt is held and guided for displacement in its longitudinal direction in the end wall 24 of the outlet pot 22, and, of course, in such a way that the outlet pipe 60 for lightweight dirt passes in a sealed-off manner through the end wall 24. It is of rotationally symmetrical design, arranged coaxially with the apparatus axis 18 and strictly circular-cylindrical, except for a conical inlet area 60*a*. For better support of the outlet pipe 60, it may prove recommendable to provide the end wall 16 with supports which are designed and extend like spokes and lie in the through-opening 20 and hold a guide ring in which the outlet pipe 60 for lightweight dirt is held for displacement. The length of the circular-cylindrical part of the outlet pipe 60 for lightweight dirt is of such dimensions that it can be both pushed into a front end position, illustrated in dot-and-dash lines on the left in FIG. 1, and pulled back into a rear position which is also illustrated in dot-and-dash lines on the right in FIG. 1. In its front end position, the outlet pipe 60 for lightweight dirt ends at a relatively small axial distance from the rotor 26. In any case, this distance and the inflow diameter of the inlet area 60*a* must be selected such that a sufficiently high percentage of the lightweight dirt particles contained in the fiber suspension to be treated can be urged due to the vortex generated by the rotor 26 into areas of the interior of the housing 10 near the axis and thus grasped by the outlet pipe 60 for lightweight dirt. If this is ensured by a sufficient distance of the outlet pipe 60 for lightweight dirt from the rotor 26, it would not be advisable to further increase this axial distance of the outlet pipe 60 from the rotor 26.

As mentioned above, the heavy dirt particles are centrifuged outwards, i.e., urged into areas remote from the apparatus axis 18, by the vortex concentric with the apparatus axis 18, which is forced by the rotor 26 in the fiber suspension to be treated. That portion of the suspension flow which contains the outwardly centrifuged heavy dirt particles and has a helical-line-shaped flow course is separated by the separating wall 56 from the other fiber suspension components. This rejected stock containing heavy dirt flows in the outer annular chamber 58 in accordance with FIG. 1 form the left to the right and can be discharged from the apparatus continuously or at intervals via a outlet pipe connection 66 for heavy dirt which is provided with an adjustable valve 64. It is best for the outlet pipe connection 66 for heavy dirt to open tangentially into the circumferential wall 12 of the housing in the direction opposite to the direction of rotation of the rotor 26, but it may also prove sufficient for the pipe connection 66 to open radially from below into the circumferential wall 12 of the housing.

The so-called accepted stock, which contains at least the major part of the usable fibers of the treated fiber suspension, but no or as few as possible heavy dirt and lightweight dirt particles, flows in the inner annular chamber 70 between pipe 54 for separating heavy dirt and outlet pipe 60 for lightweight dirt with a helical-line-shaped flow course in accordance with FIG. 1 from the left to the right into the outlet pot 22, into whose circumferential wall 23 an outlet pipe connection 74 for accepted stock opens, again tangentially in the direction opposite to the direction of rotation of the rotor 26. As the accepted stock outlet does not lead out of the apparatus in the direction of the apparatus axis 18 in the illustrated preferred embodiment of the apparatus according to the invention, there can be no development of such a high axial flow velocity of the accepted stock that large quantities of lightweight dirt particles are thereby carried along by the accepted stock flow in the area before the inflow end of the outlet pipe 60 for lightweight dirt and transported into the inner annular chamber 70.

As is apparent from FIG. 1, the separate outlet pot 22 could be readily dispensed with if the circumferential wall 12 of the housing were prolonged over the right end of the outer annular chamber 58 in accordance with FIG. 1 and provided with the outlet pipe connection 74 for accepted stock and an end wall corresponding to the end wall 24.

It is further apparent from FIG. 1 that all parts which are particularly prone to wear due to the heavy dirt particles contained in the fiber suspension to be treated are readily exchangeable, namely the accelerator vanes 44 of the rotor 26, the circumferential wall 12 of the housing and the pipe 54 for separating heavy dirt.

The inclination of the accelerator vanes 44 in relation to the direction of the apparatus axis 18 could be readily made adjustable. Also the cap 40 of the rotor 26 could similarly be provided with elements for driving the fiber suspension in the direction of rotation.

As the three-phase AC motor 30 is operated via a frequency converter whose output frequency is adjustable so the rotational speed of the rotor 26 is easily alterable and adjustable, the power consumption of the apparatus according to the invention can be minimized. The same purpose is served by the possibility of displacing the outlet pipe 60 for lightweight dirt in the axial direction so as to be able to adapt the position of the inflow end of the outlet pipe 60 to the forced vortex dependent upon the rotational speed of the rotor, which also optimizes the separation of the lightweight dirt particles at the same time.

The main details of the axial distance of the inflow end of the pipe 54 for separating heavy dirt from the rotor 26 and of the inflow diameter of this separating pipe in relation to the rotor diameter have already been given above. However, it is apparent from FIG. 1 that the pipe for separating heavy dirt can end at a relatively small axial distance from that area of the rotor which accelerates the fiber suspension flowing into the apparatus in the direction of rotation or carries out the major part of this accelerating work (in the illustrated case it is the rotor casing 38 with the accelerator vanes 44). FIG. 1 also shows that the outer diameter of the pipe 54 for separating heavy dirt is not smaller than the outer diameter of the rotor casing 38.

The axial distance of the inflow end of the outlet pipe 60 for lightweight dirt from the accepted stock outlet, i.e., from the outlet pipe connection 74 for accepted stock should be chosen so large that the flow of accepted stock leaving the apparatus can have no such retroactive effects on the flow in the area of the inlet of the outlet pipe for lightweight dirt that a considerable number of lightweight dirt particles is carried along by the flow of accepted stock into the inner annular chamber 70.

The apparatus according to the invention may also comprise the following further features which are not illustrated in the drawings:

In the area of the rotor 26, the inside of the circumferential wall 12 of the housing may have a surface structure by means of which turbulences are generated in the fiber suspension to be treated in order to fluidize the fibrous material in the carrier liquid so that fine impurities are dissolved from the fiber combination. In this case, it is, however, expedient for the area of the circumferential wall 12 of the housing generating the turbulences not to extend as far as the outflow end of the rotor casing 38 and the accelerator vanes 44 in order that a rotor area effectively driving the suspension in the circumferential direction still remains downstream of the surface area generating the turbulences and acts upon the fiber suspension.

All apparatus parts subject to abrasive wear but, above all, the inside of the circumferential wall 12 of the housing is or are expediently provided with a wear-resistant coating.

Since, as mentioned above, heavy dirt particles tend to settle in the lower area of the circumferential wall 12 of the housing under the influence of gravity, a measure may be recommendable which ensures or accelerates axial conveyance of the heavy dirt particles to the heavy dirt outlet. For this purpose, it is easiest to provide the inside of the circumferential wall 12 of the housing with a kind of thread which may be a single thread or a multiple thread and may be formed by a groove of helical-line-shaped configuration in the circumferential wall 12.

With a stock density of the fiber suspension to be treated of approximately 1%, sand as heavy dirt to be separated off was separated extremely effectively with the inventive apparatus illustrated in FIGS. 1 and 2—the degree of separation was up to 90%. In this case, the power consumption of the apparatus was comparatively low—with a throughput of 3,000 liters of fiber suspension per minute, the power consumption was only approximately 30 kW.

Further tests showed that the apparatus according to the invention can be operated in an extremely economical way, namely with an energy expenditure of only 20 kWh per ton of processed fiber suspension (taking into consideration an output of a pump feeding the suspension to the apparatus of 11 kW for the example described in the preceding paragraph).

It was also found that an apparatus according to the invention can be operated with stock densities of up to approximately 2.5% if one does not make too high demands on the degree of separation of the heavy dirt.

A special advantage of the apparatus according to the invention is that the amounts of rejected stock produced are extremely low—the rejected stock containing the heavy dirt and the rejected stock containing the lightweight dirt are in each case only approximately 3% of the amount of fiber suspension fed to the apparatus for processing.

The second particularly advantageous embodiment of the apparatus according to the invention illustrated in FIGS. 3 and 4 differs from the embodiment according to FIGS. 1 and 2 only in the design of the pipe for separating heavy dirt and, for this reason, only this will be described. For all other parts of the second embodiment, the same reference numerals were used in FIGS. 3 and 4 as in FIGS. 1 and 2.

Figure 3:
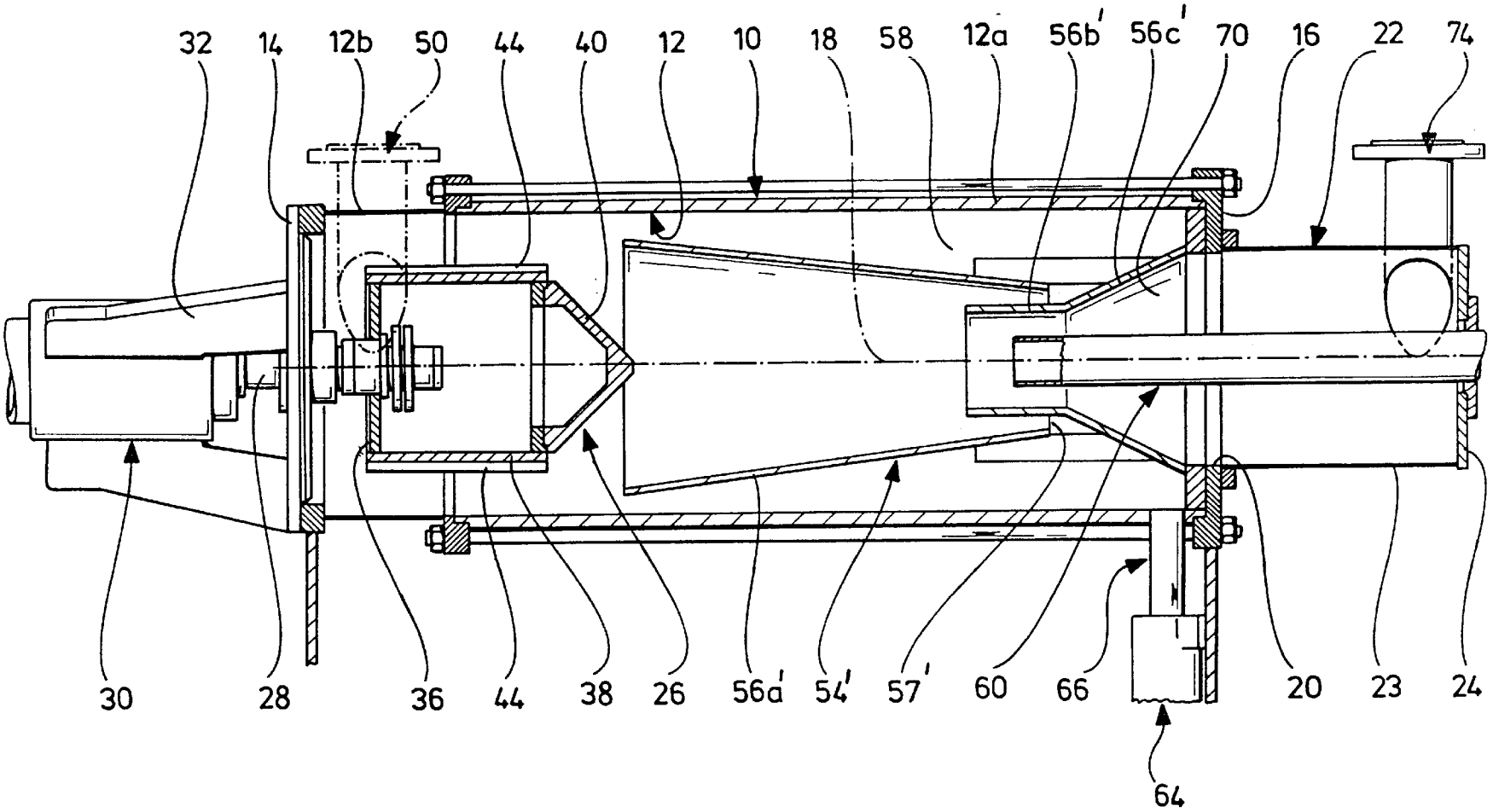
FIGS. 3 and 4 illustrations of the second embodiment corresponding to FIGS. 1 and 2.
Figure 4:
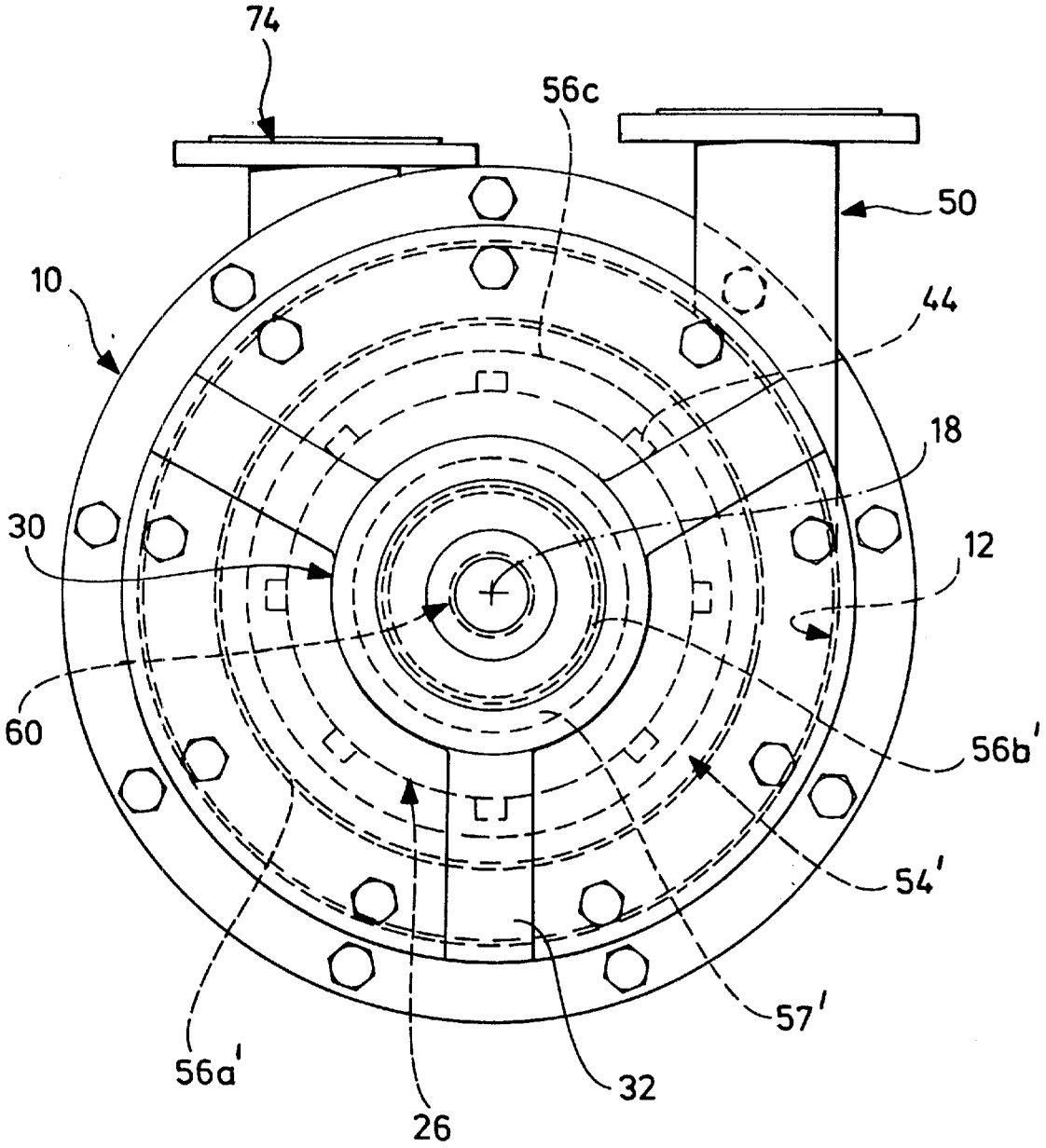

The pipe for separating heavy dirt in the apparatus illustrated in FIGS. 3 and 4 which is designated in its entirety 541 is again formed by a separating wall which is rotationally symmetrical in relation to the apparatus axis 18 and consists of an inflow wall section 56*a*', a middle wall section 56*b*' and an outflow wall section 56*c*'. The wall section 56*a*' forms a cone opening towards the rotor 26, the wall section 56*b*' represents a circular cylinder, and the wall section 56*c*' forms a cone expanding in the direction of the axial flow through the apparatus and corresponding to the conical wall section 56*b* of the apparatus illustrated in FIG. 1. The special features of the apparatus according to FIGS. 3 and 4 are to be seen in the following:

The fiber suspension to be treated which is accelerated by the rotor 26 to almost its circumferential speed forms in the first part of the pipe 54' for separating heavy dirt consisting of the wall section 56*a*' a free vortex which owing to the axial flow component of the fiber suspension directed from the left to the right in accordance with FIG. 3 in the funnel formed by the wall section 56*a*' results in the same effect as in a centricleaner described at the outset. Heavy dirt particles still contained in the flow of accepted stock are centrifuged out in this way, namely forced against the inside wall of the wall section 56*a*'. Since the outer diameter of the wall section 56*b*' is smaller than the inner diameter of the wall section 56*a*' at its outflow end, and on account of the axial flow component of the accepted stock flowing through the separating pipe 54', the heavy dirt particles centrifuged out in the cone formed by the wall section 56*a*' exit together with a small portion of the fiber suspension from the annular gap 57' into the outer annular chamber 58, whereas the component of the flow of accepted stock freed from these heavy dirt particles flows through the pipe formed by the wall section 56*b*' into the expanding cone formed by the wall section 56*c*' and then enters the outlet pot 22.

With such an apparatus design it is expedient to make the inflow diameter of the pipe for separating heavy dirt somewhat larger than the rotor diameter in order to catch as large a component as possible of the suspension flow carrying along usable fibers with it and allow it to enter the interior of the pipe for separating heavy dirt. In the apparatus variant illustrated in FIGS. 3 and 4, one can afford to do this because any heavy dirt particles entering the interior of the pipe for separating heavy dirt are screened off via the annular gap 57'.

Aside from that, the wall section 56*a*' can be held by, for example, three spoke-shaped supports which are distributed over the circumference of the pipe 54' for separating heavy dirt and are connected, on the one hand, to the wall section 56*a*' and, on the other hand, to some part or other which is rigidly connected directly or indirectly to the housing 10, whether it be the circumferential wall 12 or, for example, the wall section 56*b*' or the wall section 56*c*'.

A special feature of the apparatus according to the invention is to be seen in that the outer annular chamber, i.e., for example, the annular chamber 58 in FIG. 1, forms a storage volume for heavy dirt. With an appropriate design and arrangement of the outlet pipe for lightweight dirt, for example, the pipe 60 shown in FIG. 1, the apparatus according to the invention also comprises a relatively large storage volume for lightweight dirt.

In an advantageous further development of the invention, the apparatus may be provided with means for reducing the component of still usable fibers which leave the apparatus via the heavy dirt outlet. For this purpose, the circumferential wall of the outer housing is provided with one or several orifices for so-called barrier or rinsing water, preferably with several such orifices distributed over the circumference of the outer housing. This orifice or these orifices is or are arranged in an area of the circumferential wall of the outer housing which is located in the area of the outer annular chamber, preferably somewhat closer to the heavy dirt outlet than at the rotor end of the separating wall (separating wall 56 in FIG. 1) delimiting the outer annular chamber. Still usable fibers are washed out of the heavy dirt by the water introduced through this orifice or these orifices, and the course of the flow of water introduced, which is approximately radial at least near the orifice, has a kind of retaining effect on the fibers of light specific weight.

What is claimed is:

1. An apparatus for processing fiber suspensions, said fiber suspensions containing particles to be separated off from the usable fibers of the suspension, the specific weight of said particles differing distinctly from that of said usable fibers, comprising an essentially drum-shaped outer housing accommodating in the zone of its one inflow end a body which is essentially rotationally symmetrical in relation to the housing axis, said outer housing being provided with an inlet for the fiber suspension to be processed and accommodating in the zone of its other outflow end a stationary outlet pipe concentric with the housing axis for a lightweight dirt portion of the suspension containing particles to be separated off and having a specific weight less than the specific weight of said usable fibers, and said outer housing being provided with an accepted stock outlet for an accepted stock portion of the suspension containing essentially usable fibers, and further comprising a rotary drive for generating in the annular chamber between said outer housing and said rotationally symmetrical body a flow component which is rotatory in relation to the housing axis, wherein said outer housing and said accepted stock outlet are stationary, and said rotationally symmetrical body is in the form of a rotor rotationally drivable about said housing axis, wherein a separating wall rotationally symmetrical with said housing axis is provided, said separating wall forming together with a circumferential wall of said outer housing an outer annular chamber which is open at its end facing said rotor and is closed in the opposite direction, said outer annular chamber being provided at an axial distance from its open end with an outlet for a heavy dirt portion of the suspension containing particles to be separated off and having a specific weight greater than the specific weight of said usable fibers, and wherein said accepted stock outlet communicates with the outflow end of an inner annular chamber located between said separating wall and said outlet pipe for lightweight dirt.

2. Apparatus as defined in claim 1 wherein said inlet for the fiber suspension to be processed is in the form of a pipe opening tangentially into said outer housing in the direction of rotation of said rotor, and said accepted stock outlet comprises a pipe leading away tangentially in the direction of rotation of said rotor.

3. Apparatus as defined in claim 1, wherein said heavy dirt outlet leads away tangentially from said outer annular chamber in the direction of rotation of said rotor.

4. Apparatus as defined in claim 1, wherein said axis of said outer housing extends at least approximately horizontally.

5. Apparatus as defined in claim 4, wherein said heavy dirt outlet opens from below into said outer annular chamber.

6. Apparatus as defined in claim 1, wherein said separating wall exhibits at its end facing said rotor such a radial distance from said circumferential wall of said outer housing and such an axial distance from said rotor that an annular flow area generated by said rotor adjacent to said circumferential wall of said outer housing and containing on account of centrifugal forces at least a considerable portion of said heavy dirt and having a rotatory flow component in relation to said housing axis enters said outer annular chamber owing to the axial flow through said apparatus.

7. Apparatus as defined in claim 1, wherein the inlet diameter of said outlet pipe for lightweight dirt of its end facing said rotor and the axial distance of said end from said rotor are of such dimensions that a core area of flow generated by said rotor and containing at least a considerable portion of said lightweight dirt, being concentric with said housing axis and containing said housing axis enters said outlet pipe for lightweight dirt owing to the axial flow through said apparatus.

8. Apparatus as defined in claim 1, wherein the axial distance of said end of said outlet pipe for lightweight dirt facing said rotor from said accepted stock outlet is at least as large as the distance from said rotor.

9. Apparatus as defined in claim 8, wherein the distance of said end of said outlet pipe for lightweight dirt facing said rotor from said accepted stock outlet is a multiple of the distance from said rotor.

10. Apparatus as defined in claim 1, wherein said outlet pipe for lightweight dirt is displaceable in the axial direction.

11. Apparatus as defined in claim 1, wherein the axial distance of the rotor end of said separating wall from said rotor is at least as large as the distance from said outlet for heavy dirt.

12. Apparatus as defined in claim 11, wherein the axial distance of the rotor end of said separating wall from said outlet for heavy dirt is a multiple of the distance from said rotor.

13. Apparatus as defined in claim 1, wherein said rotor is provided at its outer circumference with elevations accelerating the suspension in the direction of rotation.

14. Apparatus as defined in claim 1, wherein the outer diameter of said rotor is approximately as large as or larger than the outer diameter of the rotor end of said separating wall.

15. Apparatus as defined in claim 1, wherein said rotor is of conical design at its outflow end.

16. Apparatus as defined in claim 1, wherein a valve is allocated to said outlet pipe for lightweight dirt.

17. Apparatus as defined in claim 1, wherein said outlet for heavy dirt is provided with a valve.

18. Apparatus as defined in claim 1, wherein said inlet opens tangentially into said circumferential wall of said outer housing in the area of the circumference of said rotor and in the direction of rotation of said rotor.

19. Apparatus as defined in claim 1, wherein said rotary drive comprises a three-phase AC motor supplied via an adjustable frequency converter.

20. Apparatus as defined in claim 1, wherein at least one of the following apparatus components is exchangeably mounted: circumferential area of the rotor or parts thereof, outlet pipe for lightweight dirt and separating wall.

21. Apparatus as defined in claim 1, wherein said separating wall is designed so as to open conically towards said rotor at least in an axial section facing said rotor, and wherein said separating wall has approximately at the end of the conical section remote from said rotor at least one opening for passage of heavy dirt into said outer annular chamber.

22. Apparatus as defined in claim 21 wherein said opening is an annular gap extending in the circumferential direction.

23. Apparatus as defined in claim 21, wherein said separating wall expands conically between through-opening and outflow end.

24. Apparatus as defined in claim 22, wherein said separating wall expands conically between through-opening and outflow end.

* * * * *